US007880459B2

(12) United States Patent
Harvey

(10) Patent No.: US 7,880,459 B2
(45) Date of Patent: Feb. 1, 2011

(54) CIRCUITS AND METHODS TO PRODUCE A VPTAT AND/OR A BANDGAP VOLTAGE

(75) Inventor: Barry Harvey, Los Altos, CA (US)

(73) Assignee: Intersil Americas Inc., Milpitas, CA (US)

( * ) Notice: Subject to any disclaimer, the term of this patent is extended or adjusted under 35 U.S.C. 154(b) by 380 days.

(21) Appl. No.: 12/111,796

(22) Filed: Apr. 29, 2008

(65) Prior Publication Data

US 2008/0278137 A1 Nov. 13, 2008

Related U.S. Application Data

(60) Provisional application No. 60/928,893, filed on May 11, 2007.

(51) Int. Cl.
*G05F 3/16* (2006.01)
*G05F 3/20* (2006.01)

(52) U.S. Cl. ..... 323/313; 327/539

(58) Field of Classification Search ..... 323/313–317; 327/539

See application file for complete search history.

(56) References Cited

U.S. PATENT DOCUMENTS

| | | | |
|---|---|---|---|
| 4,952,866 | A | 8/1990 | Van Tuijl |
| 5,519,354 | A | 5/1996 | Audy |
| 5,619,122 | A | 4/1997 | Kearney et al. |
| 5,796,280 | A | 8/1998 | Tuozzolo |
| 5,982,221 | A | 11/1999 | Tuthill |
| 6,008,685 | A | 12/1999 | Kunst |
| 6,019,508 | A | 2/2000 | Lien |
| 6,037,832 | A | 3/2000 | Kaminishi |
| 6,157,244 | A | 12/2000 | Lee et al. |
| 6,554,469 | B1 | 4/2003 | Thomson et al. |
| 6,736,540 | B1 | 5/2004 | Sheehan et al. |
| 6,890,097 | B2 | 5/2005 | Tanaka |
| 6,914,475 | B2 | 7/2005 | Enriquez et al. |
| 6,957,910 | B1 | 10/2005 | Wan et al. |
| 7,083,328 | B2 | 8/2006 | Johnson |

(Continued)

OTHER PUBLICATIONS

Kuijk, K., "A Precision Reference Voltage Source," IEEE J. Solid State Circuits, vol. SC-8, Jun. 1973, pp. 222-226.

(Continued)

*Primary Examiner*—Harry Behm
*Assistant Examiner*—Matthew Grubb
(74) *Attorney, Agent, or Firm*—Fiesler Meyer LLP

(57) ABSTRACT

Provided herein are circuits and methods to generate a voltage proportional to absolute temperature (VPTAT) and/or a bandgap voltage output (VGO). A circuit includes a group of X transistors. A first subgroup of the X transistors are used to produce a first base-emitter voltage (VBE1). A second subgroup of the X transistors are used to produce a second base-emitter voltage (VBE2). The VPTAT can be produced by determining a difference between VBE1 and VBE2. Which of the X transistors are in the first subgroup and used to produce the first base-emitter voltage (VBE1), and/or which of the X transistors are in the second subgroup and used to produce the second base-emitter voltage (VBE2), change over time. Additionally, a circuit portion can be used to generates a voltage complimentary to absolute temperature (VCTAT) using at least one of the X transistors. The VPTAT and the VCTAT can be added to produce the VGO.

27 Claims, 11 Drawing Sheets

U.S. PATENT DOCUMENTS

| | | | | |
|---|---|---|---|---|
| 7,170,334 | B2 | 1/2007 | Miranda et al. | |
| 7,193,543 | B1 | 3/2007 | McLeod et al. | |
| 7,236,048 | B1 | 6/2007 | Holloway et al. | |
| 7,281,846 | B2 | 10/2007 | McLeod | |
| 7,309,157 | B1 | 12/2007 | Aslan et al. | |
| 7,312,648 | B2 | 12/2007 | Yang | |
| 7,321,225 | B2 | 1/2008 | Garlapati et al. | |
| 7,341,374 | B2 | 3/2008 | Chiu | |
| 7,368,973 | B2 | 5/2008 | Sato | |
| 2005/0001605 | A1 * | 1/2005 | Marinca | 323/314 |
| 2006/0255787 | A1 * | 11/2006 | Schaffer et al. | 323/315 |
| 2007/0152740 | A1 * | 7/2007 | Georgescu et al. | 327/539 |

OTHER PUBLICATIONS

Song, B. et al., "A Precision Curvature-compensated CMOS Bandgap Reference," IEEE J. Solid State Circuits, vol. Sc-18, Dec. 1983, pp. 634-643.

Tuthill, M., "A Switched-current, Switched-capacitor Temperature Sensor in 0.6 um CMOS," IEEE J. Solid State Circuits, vol. SC-33, Jul. 1998, pp. 1117-1122.

Pertijs, M. et al., "A CMOS Smart Temperature Sensor with a 3 Sigma Inaccuracy of +/−0.5 deg C. from −50 to 120 deg C.," IEEE J. Solid State Circuits, vol. SC-40, Feb. 2005, pp. 454-461.

Pertijs, M. et al., "A CMOS Smart Temperature Sensor with a 3 Sigma Inaccuracy of +/−0.1 deg C. from −55 to 125 deg C.," IEEE J. Solid State Circuits, vol. SC-40, Dec. 2005, pp. 2805-2815.

Huijsing, J. et al., "Analog Circuit Design," Boston/Dordrecht/London: Kluwer Academic, 1996, pp. 350-351.

Pertijs, M. et al., "A High-Accuracy Temperature Sensor with Second-order Curvature Correction and Digital Bus Interface," in Proc. ISCAS, May 2001, pp. 368-371.

Pease, Robert, "The Design of Band-Gap reference Circuits: Trials and Tribulations," IEEE Proceedings of the 1990 Bipolar Circuits and Technology Meeting, Sep. 17-18, 1990.

* cited by examiner

CIRCUITS AND METHODS TO PRODUCE A VPTAT AND/OR A BANDGAP VOLTAGE

PRIORITY CLAIM

The present application claims priority under 35 U.S.C. 119(e) to U.S. Provisional Patent Application No. 60/928,893, filed May 11, 2007, which is incorporated herein by reference.

BACKGROUND

A voltage proportional to absolute temperature (VPTAT) can be used, e.g., in a temperature sensor as well as in a bandgap voltage reference circuit. A bandgap voltage reference circuit can be used, e.g., to provide a substantially constant reference voltage for a circuit that operates in an environment where the temperature fluctuates. A bandgap voltage reference circuit typically adds a voltage complimentary to absolute temperature (VCTAT) to a voltage proportional to absolute temperature (VPTAT) to produce a bandgap reference output voltage (VGO). The VCTAT is typically a simple diode voltage, also referred to as a base-to-emitter voltage drop, forward voltage drop, base-emitter voltage, or simply VBE. Such a diode voltage is typically provided by a diode connected transistor (i.e., a BJT transistor having its base and collector connected together). The VPTAT can be derived from one or more VBE, where ΔVBE (delta VBE) is the difference between the VBEs of BJT transistors having different emitter areas and/or currents, and thus, operating at different current densities. However, because BJT transistors age in a generally random manner, the VPTAT (as well as the VCTAT) will tend to drift over time, which will adversely affect a temperature sensor and/or a bandgap voltage reference circuit that relies on the accuracy of the VPTAT (and the accuracy of the VCTAT in the case of a bandgap voltage reference circuit). It is desirable to reduce such drift. Additionally, VPTAT and bandgap voltage reference circuits generate noise, a strong component of which is 1/F noise (sometimes referred to as flicker noise), which is related to the base current. It is desirable to reduce 1/F noise.

SUMMARY OF THE INVENTION

Provided herein are circuits and methods to generate a voltage proportional to absolute temperature (VPTAT) and/or a bandgap voltage output (VGO). In accordance with an embodiment, a circuit includes a group of X transistors. A first subgroup of the X transistors are used to produce a first base-emitter voltage (VBE1). A second subgroup of the X transistors are used to produce a second base-emitter voltage (VBE2). The VPTAT can be produced by determining a difference between VBE1 and VBE2. Which of the X transistors are in the first subgroup and used to produce the first base-emitter voltage (VBE1), and which of the X transistors are in the second subgroup and used to produce the second base-emitter voltage (VBE2), selectively changes over time. Additionally, a circuit portion can be used to generates a voltage complimentary to absolute temperature (VCTAT) using at least one of the X transistors. The VPTAT and the VCTAT can be added to produce the VGO.

Further and alternative embodiments, and the features, aspects, and advantages of the embodiments of invention will become more apparent from the detailed description set forth below, the drawings and the claims.

DETAILED DESCRIPTION

Figure 1:
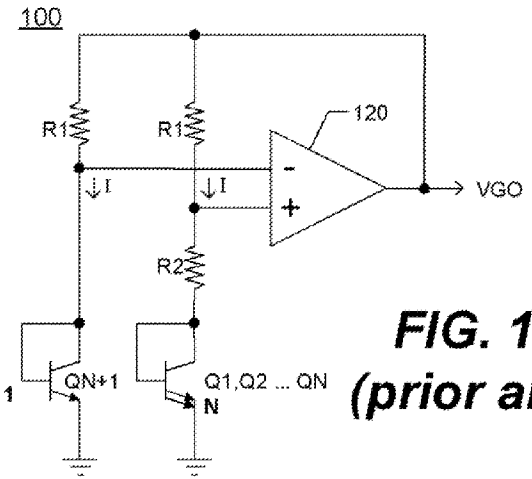
FIG. 1 (prior art)
FIG. 1 illustrates an exemplary conventional bandgap voltage reference circuit.

FIG. 1 illustrates an exemplary conventional bandgap voltage reference circuit 100 that includes N+1 transistors, including diode connected transistors Q1 through QN connected in parallel, a further diode connected transistor QN+1, a differential input amplifier 120, a pair of resistors R1, and a resistor R2. In this arrangement, the transistor QN+1 is used to generate a VCTAT, and transistors Q1 through QN in conjuntion with transistor Qn+1 are used to generate the VPTAT. More specifically, the VCTAT is a function of the base emitter voltage (VBE) of transistor QN+1, and the VPTAT is a function of ΔVBE, which is a function of the difference between the base-emitter voltage of transistor QN+1 and the base-emitter voltage of parallel connected transistors Q1 through QN. Here, the bandgap voltage output (VGO) is as follows: VGO=VBE+(R1/R2)*Vt*ln(N). IfVBE ~0.7V, and (R1/R2)*Vt*ln(N)~0.5V, then VGO~1.2V. In the arrangement of FIG. 1, because transistor QN+1 will age differently than at least some of transistors Q1 through QN, the bandgap voltage output (VGO) will drift over time, which is undesirable.

Figure 2:
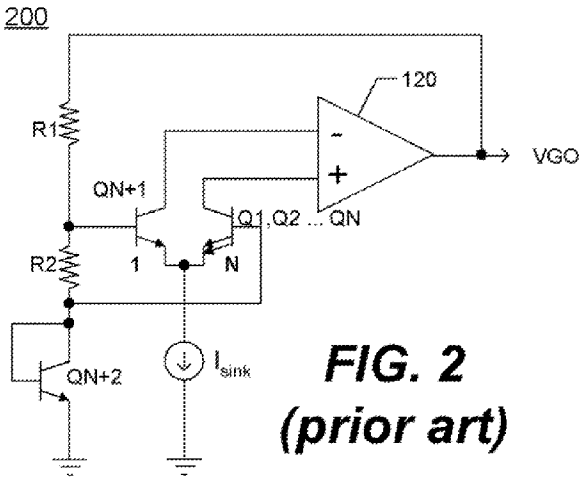
FIG. 2 (prior art)
FIG. 2 illustrates an alternative exemplary conventional bandgap voltage reference circuit.

FIG. 2 illustrates an alternative exemplary conventional bandgap voltage reference circuit 200, including transistors Q1 through QN connected in parallel, a further transistor QN+1, a differential input amplifier 120, a resistor R1, a resistor R2, a diode connected transistor QN+2, and a current sink I. In this arrangement, the transistor QN+2 is used to generate a VCTAT, and transistors Q1 through QN+1 are used to generate a VPTAT. In this arrangement, if the transistor QN+2 ages differently than at least some of the transistors Q1 through QN+1, then the VCTAT will drift relative to the VPTAT, causing an undesirable drift in the VGO. Also, if transistor QN+1 ages differently than at least some of transistors Q1 through QN, then the VPTAT will drift, causing an undesirable drift in the VGO.

Figure 3:
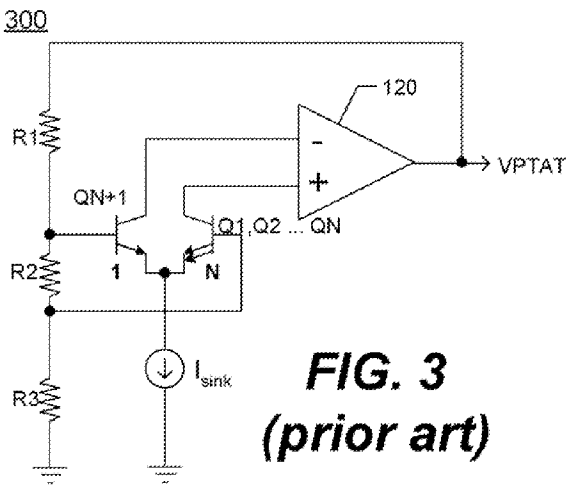
FIG. 3 (prior art)
FIG. 3 illustrates an exemplary circuit for generating a voltage proportional to absolute temperature (VPTAT).

FIG. 3 illustrates an exemplary conventional circuit 300 for generating a VPTAT, including transistors Q1 through QN connected in parallel, a further transistor QN+1, a differential input amplifier 120, resistors R1, R2 and R3, and a current sink I. In this arrangement, if the transistor QN+1 ages differently than at least some of the transistors Q1 through QN, then an undesirable drift in the VPTAT will occur. A comparison between FIG. 3 and FIG. 2 shows that FIG. 3 is the same as FIG. 2, except that transistor QN+2 is replaced with the resistor R3 in FIG. 3.

FIGS. 1-3 are used to illustrate a deficiency of some exemplary conventional bandgap voltage reference circuits and VPTAT circuits. The same deficiency exists in other bandgap voltage reference circuits and VPTAT circuits. Accordingly, while the FIGS. discussed below are used to explain how the deficiencies of FIGS. 1-3 can be overcome, one of ordinary skill in the art would appreciate from the description herein how the concepts of embodiments of the present invention can be applied to alternative bandgap voltage reference circuits and alternative VPTAT circuits. Accordingly, embodiments of the present invention can be applied to such other circuits, and are still within the scope of the present invention.

Figure 4A:
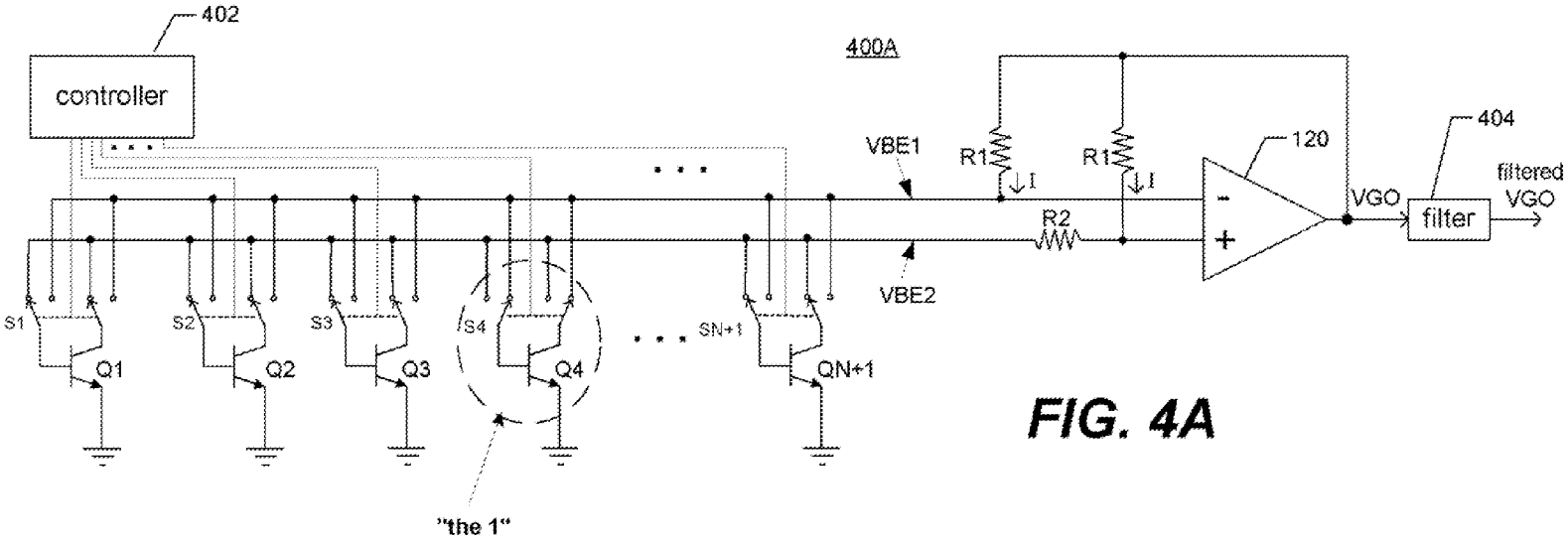
FIG. 4A illustrates a bandgap voltage reference circuit, according to an embodiment of the present invention.

FIG. 4A illustrates a bandgap voltage reference circuit 400A, according to an embodiment of the present invention, which is a modification of the circuit 100 discussed above with reference to FIG. 1. The bandgap voltage reference circuit 400A includes N+1 transistors (i.e., transistors Q1 through QN+1), a differential input amplifier 120, a pair of resistors R1, and a resistor R2. The bandgap voltage reference circuit 400A also includes switches S1 through SN+1, which are each shown as double-pole-double-throw switches. In place of the double-pole-double-throw switches, a pair of single-pole-single-throw switches can be used, but such a pair will still be referred to as a switch. The switches can be implemented, e.g., using CMOS transistors.

A comparison of FIG. 4A to FIG. 1 shows that transistor Q4 in FIG. 4A is connected by switch S4 such that it is connected in the same manner that transistor QN+1 is shown as being connected in FIG. 1; and the remaining transistors in FIG. 4A are connected by their respective switches in the same manner that transistors Q1 through QN are shown as being connected in FIG. 1. In other words, in FIG. 4A, the transistor Q4 is connected as "the 1" individual diode connected transistor, and the remaining transistors are connected as diode connected parallel transistors.

In accordance with an embodiment of the present invention, the switches are controlled by a controller 402 such that "the 1" transistor connected as the individual diode connected transistor changes over time (e.g., in a cyclical or random manner), which also means that the multiple diode connected parallel transistors change over time (e.g., in a cyclical or random manner). Stated another way, 1 of the N+1 transistors is used to produce a first base-emitter voltage (VBE1), and N of the N+1 transistors are used to produce a second base-emitter voltage (VBE2). A difference between VBE1 and VBE2 is used to produce a VPTAT. In FIG. 4A, VBEL is also used to produce a VCTAT. Which of the transistors are used to produce VBE1, and thus, the VPTAT, and the VCTAT, changes over time (e.g., in a cyclical or random manner). This way, if the VGO is averaged, e.g., using a filter 404, then the effect of any individual transistors aging is averaged out, reducing the drift of the filtered VGO.

In accordance with an embodiment of the present invention, during N+1 periods of time, each of the N+1 transistors can be selected to be used to produce the VBE1, as well as to be used to produce the VBE2. However, this is not necessary. In accordance with an embodiment of the present invention, the controller 402 controls the switches to produce a predictably shaped switching noise that can be filtered by the filter 404, or a further filter. This can include purposely not using certain transistors to produce VBE1 and/or not using certain transistors to produce VBE2, and/or not using certain transistors to produce VCTAT. The controller 402 can be implemented by a simple counter, a state machine, a micro-controller, a processor, but is not limited thereto. In certain embodiments, the controller 402 can randomly select which transistor(s) is/are used to produce VBE1 and/or which transistor(s) is/are used to produce VCTAT, e.g., using a random or pseudo-random number generator which can be implemented as part of the controller, or which the controller can access. Even where there is a random or pseudo-random sequencing of transistors, certain transistors can be purposefully not used to produce VBE1, VBE2 and/or VCTAT. Where the controller 402 cycles through which transistor(s) is/are used to produce VBE1 and/or which transistor(s) is/are used to produce VCTAT, the cycling can always be in the same order, or the order can change. Also, during the cycling certain transistors can be purposefully not used to produce VBE1, VBE2 and/or VCTAT.

In the embodiments of FIG. 4A, each transistor is always diode connected. Accordingly, each diode can be fixedly diode connected and the double-pole-double-throw switches S1 through SN+1 of FIG. 4A (or alternative the pairs of single-pole-single-throw switches), can be replaced with single-pole-single-throw switches, as shown in the bandgap voltage reference circuit 400B of FIG. 4B. In this, and other embodiments described herein, when the switches are used to selectively change a circuit configuration, the switches are preferably controlled in a make-before-break manner (i.e., a new contact is made before an old contact is broken) so that a moving contact never sees an open circuit, thereby preventing VPTAT (and/or VCTAT and/or VGO) from rapidly swinging.

Figure 4B:
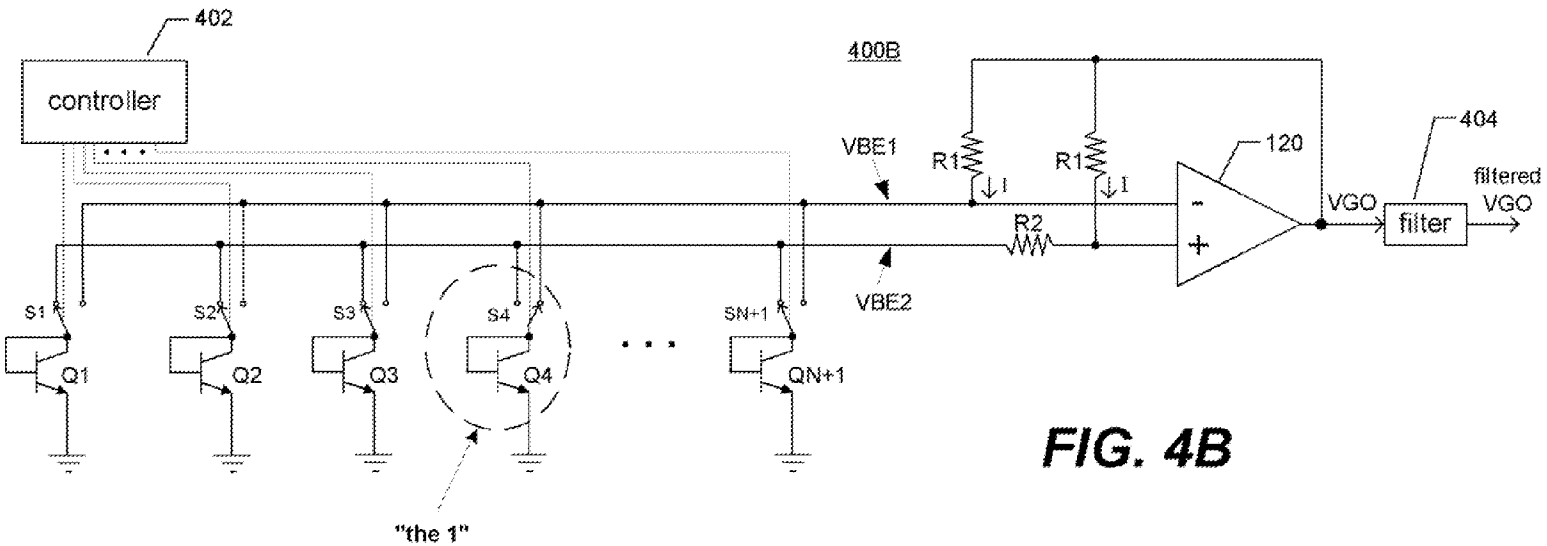
FIG. 4B illustrates a bandgap voltage reference circuit, according to another embodiment of the present invention.

In the embodiments of FIGS. 4A and 4B, assume the desire is to use a ratio of N to 1 transistors (e.g., N=8) when producing VBE1 and VBE2. This can alternatively be accomplished using 2*(N+1) transistors, connecting two transistors at a time like transistor Q4 in FIGS. 4A and 4B, and connecting the remaining 2*N transistors like transistor Q1 in FIGS. 4A and 4B. Thus, more generally, assuming X transistors are used to generate VBE1 and VBE2, a first subgroup of Y of the X transistors can be used to produce the first base-emitter voltage (VBE1), and a second subgroup of Z of the X transistors can be used to produce the second base-emitter voltage (VBE2), where $1 \leqq Y < Z < X$.

Figure 5A:
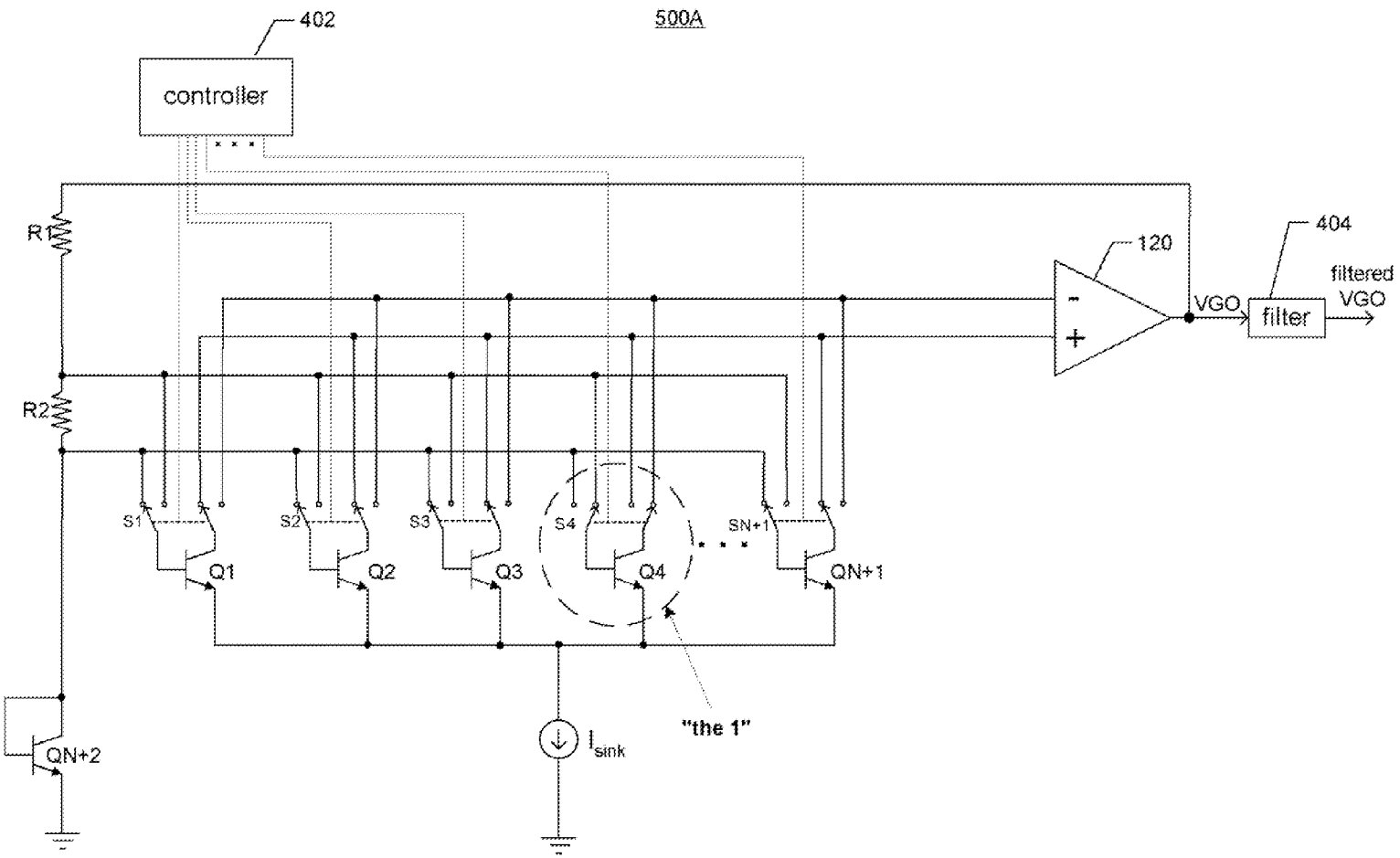
FIG. 5A illustrates a bandgap voltage reference circuit, according to a further embodiment of the present invention.

FIG. 5A illustrates a bandgap voltage reference circuit 500A, according to an embodiment of the present invention, which is a modification of the circuit 200 discussed above with reference to FIG. 2. The bandgap voltage reference circuit 500A includes N+2 transistors (i.e., transistors Q1 through QN+2), a differential input amplifier 120, a resistor R1, a resistor R2, and current sink I. The bandgap voltage reference circuit 500A also includes switches S1 through SN+1, which are each shown as double-pole-double-throw switches. In place of the double-pole-double-throw switches, a pair of single-pole-single-throw switches can be used, but the pair will still be referred to as a switch.

A comparison of FIG. 5A to FIG. 2 shows that transistor QN+2 is connected the same in both FIGS., transistor Q4 in FIG. 5A is connected by switch S4 such that it is connected in the same manner that transistor QN+1 is connected in FIG. 2, and the remaining transistors in FIG. 5A are connected by their respective switches in the same manner that transistors Q1 through QN are connected in FIG. 2. Here, 1 of the N+2 transistors is used to produce a first base-emitter voltage (VBE1), N of the N+2 transistors are used to produce a second base-emitter voltage (VBE2), and a difference between VBE1 and VBE2 is used to produce a VPTAT. In FIG. 5A, one of the N+2 transistors (i.e., transistor QN+2) is always used to produce the VCTAT. Which of the transistors are used to produce VBE1 and VBE2 changes over time (e.g., in a cyclical or random manner). This way, if the VGO is averaged, e.g., using the filter 404, then the effect of any individual transistors aging on the VPTAT is averaged out, reducing the drift of the filtered VGO.

In accordance with an embodiment of the present invention, during N+1 periods of time, each of the N+1 transistors is selected to be used to produce the VBE1, as well as to be used to produce the VBE2. However, this is not necessary. In accordance with an embodiment of the present invention, the controller 402 controls the switches to produce a predictably shaped switching noise that can be filtered by the filter 404, or a further filter. This can include purposely not using certain transistors to produce VBE1 and/or not using certain transistors to produce VBE2. Additional details of the controller 402 are discussed above. Where the controller 402 cycles through which transistor(s) is/are used to produce VBE1 and/or VBE2, the cycling can always be in the same order, or the order can change. Also, during the cycling certain transistors can be purposefully not used to produce VBE1 and/or VBE2.

Figure 5B:
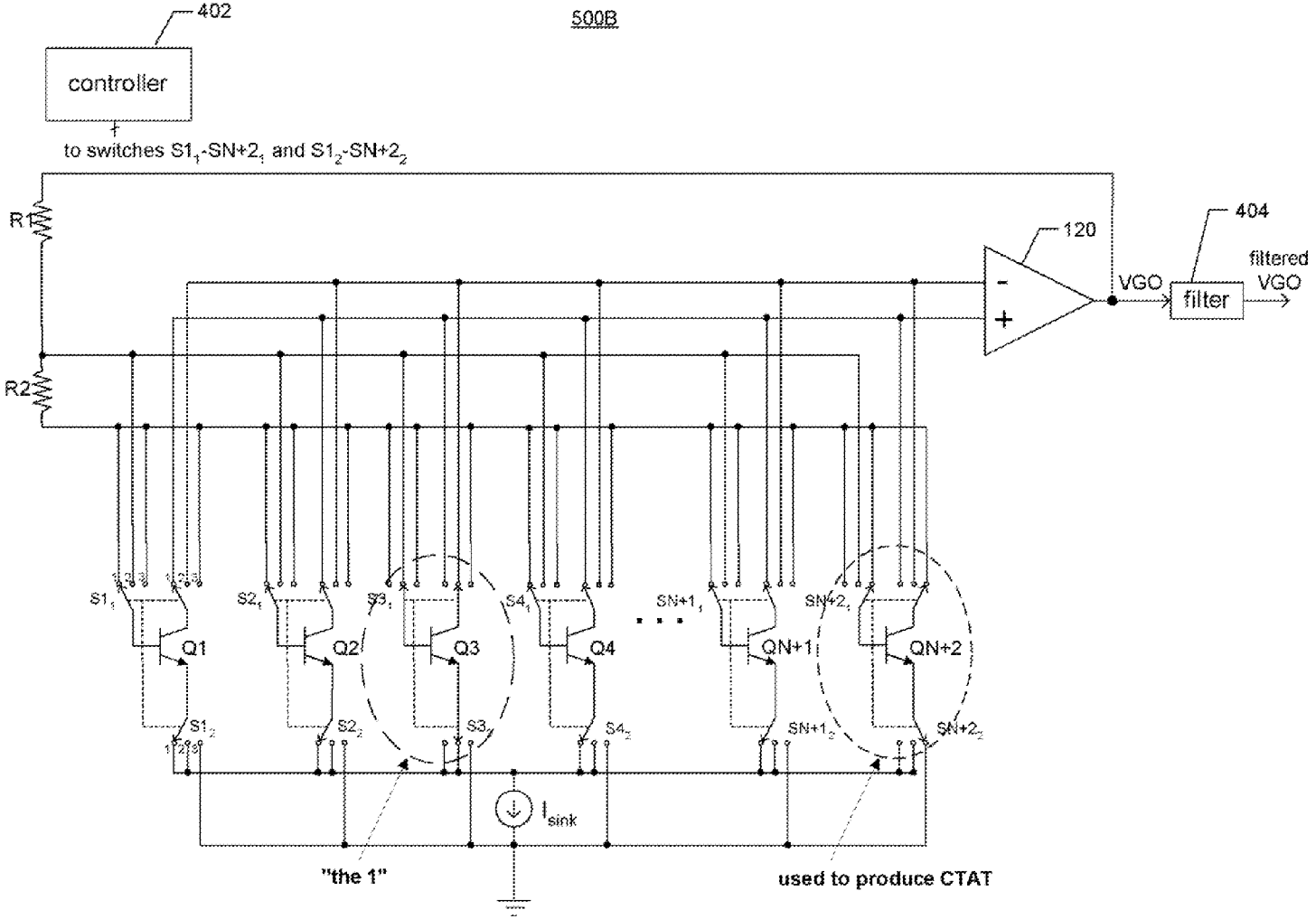
FIG. 5B illustrates a bandgap voltage reference circuit, according to still a further embodiment of the present invention.

In the bandgap reference voltage circuit 500A of FIG. 5A, the effect of aging of transistor QN+2 is not reduced. Accordingly, the bandgap reference voltage circuit 500B of FIG. 5B is provided. As can be seen in FIG. 5B, the transistor that is used to produce the VCTAT is also changed over time (e.g., in a cyclical or random manner). Here, 1 of the N+2 transistors is used to produce a first base-emitter voltage (VBE1), N of the N+2 transistors are used to produce a second base-emitter voltage (VBE2), and a difference between VBE1 and VBE2 is used to produce a VPTAT. Also, in the bandgap reference voltage circuit 500B of FIG. 5B, 1 of the N+2 transistors is used to produce the VCTAT. In FIG. 5*b*, the bandgap reference voltage circuit 500B switches $S1_1$ through $SN+2_1$ and switches S12 through $SN+2_2$ can be, e.g., double-pole-triple-throw switches, or pairs of single-pole-triple-throw switches.

In accordance with an embodiment of the present invention, during N+2 periods of time, each of the N+2 transistors is selected to be used to produce the VBE1, as well as to be used to produce the VBE2, as well as to produce the VCTAT. However, this is not necessary. In accordance with an embodiment of the present invention, the controller 402 controls the switches to produce a predictably shaped switching noise that can be filtered by the filter 404. This can include purposely not using certain transistors to produce VBE1 and/or not using certain transistors to produce VBE2, and/or not using certain transistors to produce the VCTAT. Additional details of the controller 402 are discussed above. Where the controller 402 cycles through which transistor(s) is/are used to produce VBE1 and/or VBE2 and/or which transistor(s) is/are used to produce VCTAT, the cycling can always be in the same order, or the order can change. Also, during the cycling certain transistors can be purposefully not used to produce VBE1, VBE2 and/or VCTAT.

In the embodiments of FIGS. 5A and 5B, assume the desire is to use a ratio of N to 1 transistors (e.g., N=8) when producing VBE1 and VBE2. This can alternatively be accomplished using 2*(N+1) transistors, connecting 2 transistors at a time like transistor Q4 in FIGS. 5A and 5B, and connecting 2*N transistors like transistor Q1 in FIGS. 5A and 5B. Thus, more generally, assuming X transistors are used to generate VBE1 and VBE2, a first subgroup of Y of the X transistors can be used to produce the first base-emitter voltage (VBE1), a second subgroup of Z of the X transistors can be used to produce the second base-emitter voltage (VBE2), where $1 \leqq Y \leqq Z < X$. Further, at least one of the X transistors can be used to produce the VCTAT. The transistor that is used to produce the VCTAT can stay the same, as in FIG. 5A, or change, as in FIG. 5B.

Figure 6:
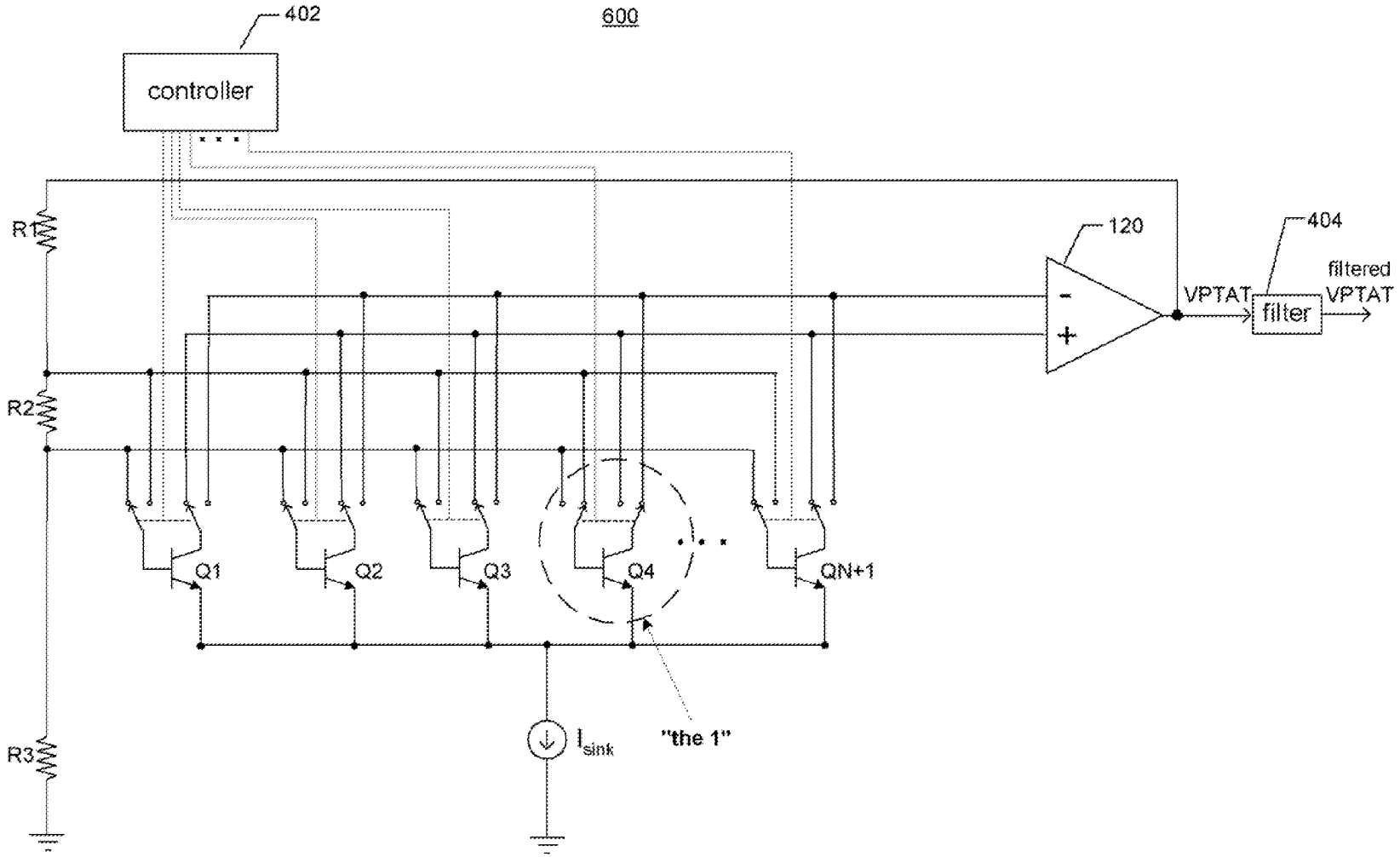
FIG. 6 illustrates a circuit for generating a voltage proportional to absolute temperature (VPTAT), according to an embodiment of the present invention.

FIG. 6 illustrates a VPTAT circuit 600, according to an embodiment of the present invention, which is a modification of the circuit 300 discussed above with reference to FIG. 3. The VPTAT circuit 600 of FIG. 6 functions in the same manner as the bandgap voltage reference circuit 500A of FIG. 5A, except that transistor QN+1 is replaced with resistor R3.

Figure 7:
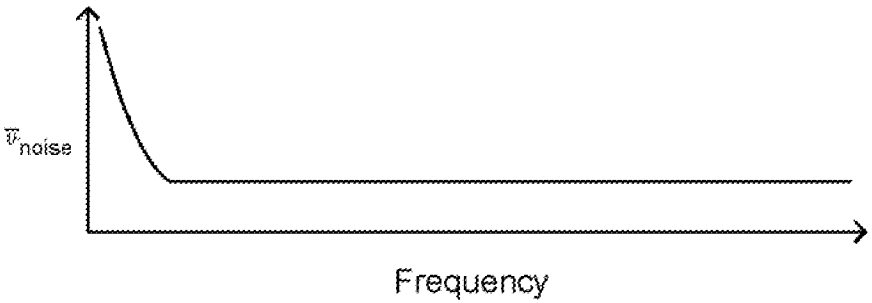
FIG. 7 illustrates exemplary 1/F noise of a conventional bandgap reference voltage or VPTAT circuit.
Figure 8:
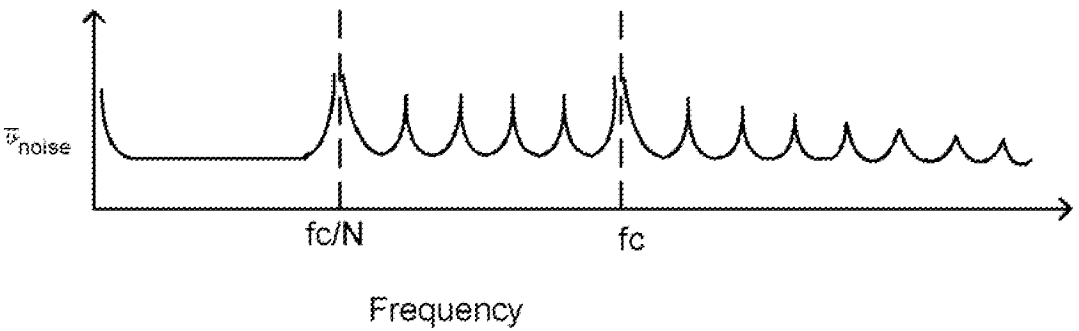
FIG. 8 illustrates how embodiments of the present invention can be used to spread the 1/F noise and thereby reduce its peak spectral content.

In the embodiments described above, a pool of bipolar junction transistors (BJTs) are provided, and one (or possibly more) of which is/are used as a ΔVBE reference to the rest of the pool. Assume a pool of N BJTs. If one BJT device (shown as "the 1" in the FIGS.) is selected to act as a ΔVBE reference against the other N−1 devices, the solo device will have a 1/f contribution, and each of the rest of the devices will each have a 1/(N−1) contribution. Since there are N−1 devices in the pool with individual 1/f noises to root mean square (RMS), we get a noise contribution of the pool as one transistor's noise divided by $\sqrt{N-1}$. The operating current will be lower compared to the solo transistor by (N−1) as well, further reducing 1/f content. Thus, the solo transistor has dominant noise, the pool's noise averaged down. By cycling one (or more) transistor out of the pool as the solo transistor at a rate much faster than 1/f, then the 1/f contribution is modulated upward in frequency. If the cycle frequency is fc, then the 1/f spectrum is promoted in frequency as shown in FIG. 7. The 1/f content of the BJTs will be reduced in RMS by $\sqrt{N}$, since N devices' noise RMS, but with a duty cycle each of 1/N. The now high-frequency 1/f noise can be filtered out, e.g., by filter 404. The cycling can be digitally controlled (e.g., randomized) to limit the peak spectral content. Now the 1/f noise is transformed so it resembles FIG. 8. This has less peak spectral content, but spreads noise down to fc/N. Note that the 1/f noise is diminished in FIG. 8, but not gone. The 1/f modulates the switching spectral peaks. For a clock of fc, there will be a lowest tone of fc/N, where there are N devices to be switched repetitively. There will be N spectral components from fc/N to not quite fc (only a few are shown). There will be harmonics of all fc/N to not quite fc components.

Stated another way, "the 1" transistor will have a 1/f noise content proportional to its operating current density. A transistor is cycled (or otherwise selected to be) in and out of "the 1" location rapidly compared to 1/f frequencies. Assuming each of the N transistors is in "the 1" position only 1/N of the time (which need not be the case), when the VGO or VPTAT signal is averaged or filtered, each transistor contributes only 1/N of its 1/f voltage. However, there are N transistors each with an independent noise to be added in turn to "the 1" position. Thus, "the 1" transistor ends up contributing $\sqrt{N}/N$ or $1/\sqrt{N}$ of the its 1/f noise. The rest of the N transistors' 1/f energy is promoted to higher spectrum by the cyclic modulation process. The other N−1 transistors contribute the same noise as do the N−1 transistors of a conventional stationary bandgap, although this is smaller than the 1/f noise of "the 1" transistor due to smaller current density.

Figure 9A:
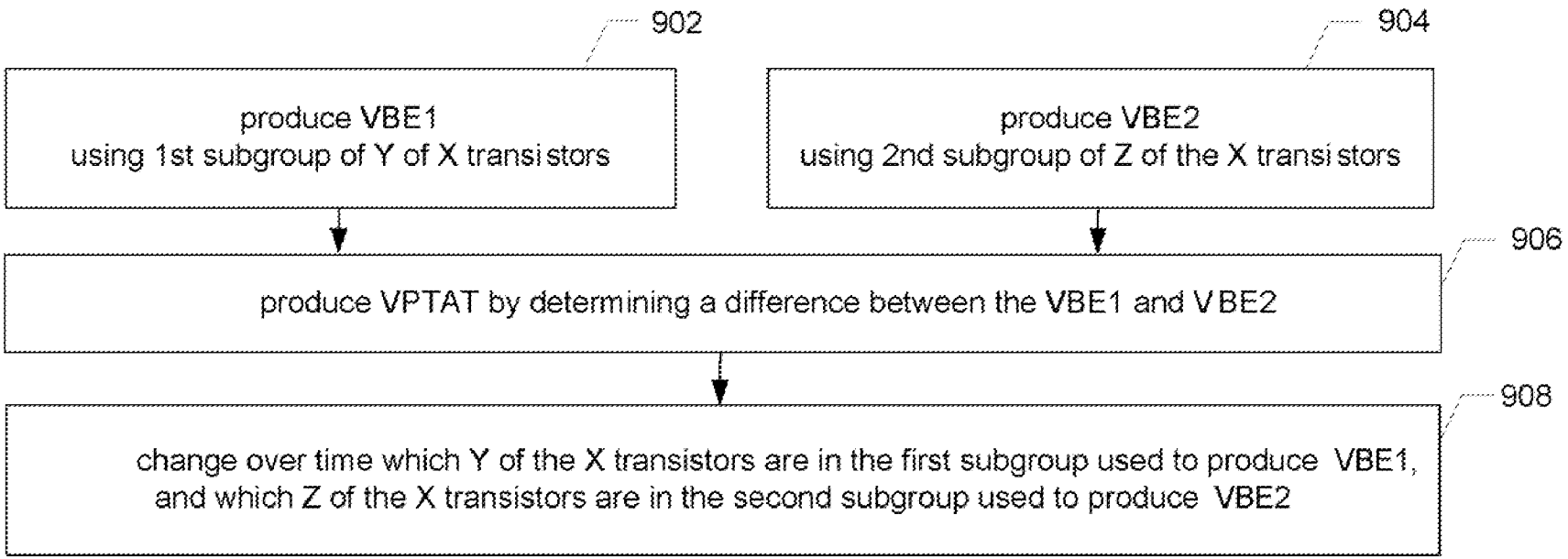
FIG. 9A is a high level flow diagram used to summarize various embodiments of the present invention for producing a VPTAT.

FIG. 9A is a high level flow diagram that is used to summarize methods of the present invention for producing a VPTAT using a group of X transistors. At step 902, a first base-emitter voltage (VBE1) is produced using a first subgroup of Y of the X transistors, where $1 \leqq Y < X$. At step 904, a second base-emitter voltage (VBE2) is produced using a second subgroup of Z of the X transistors, where $Y < Z < X$. At step 906, the VPTAT is produced by determining a difference between the first base-emitter voltage (VBE1) and the second base-emitter voltage (VBE2). At step 908, which Y of the X transistors are in the first subgroup that are used to produce the first base-emitter voltage (VBE1), and which Z of the X transistors are in the second subgroup that are used to produce the second base-emitter voltage (VBE2), are changed over time (e.g., in a cyclical or random manner). In specific embodiments, Y=1. In other embodiments $Y \leqq 2 < X/2$.

Figure 9B:
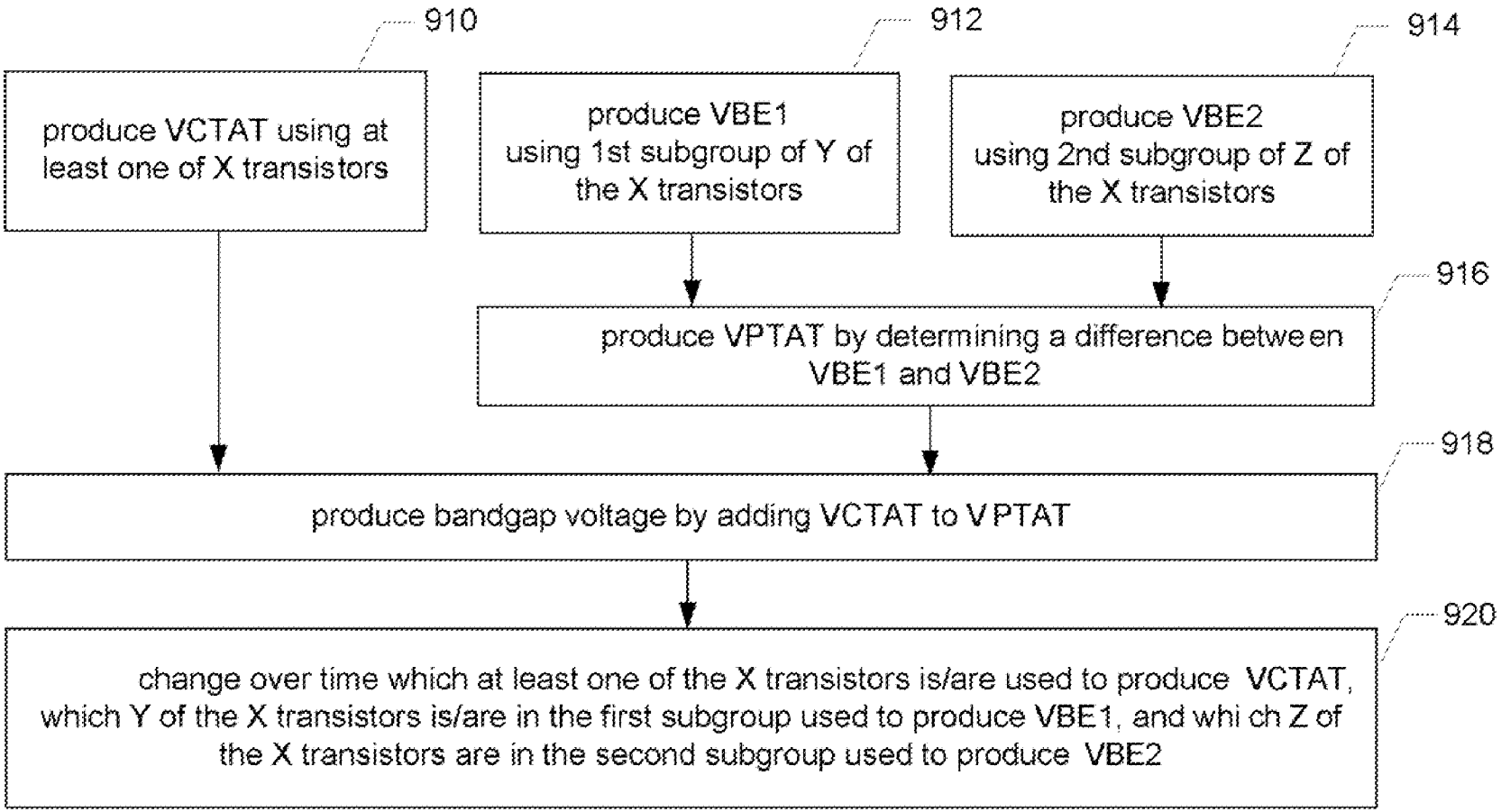
FIG. 9B is a high level flow diagram used to summarize further embodiments of the present invention for producing a bandgap voltage.

FIG. 9B is a high level flow diagram that is used to summarize methods of the present invention for producing a bandgap voltage using a group of X transistors. At step 910, a voltage complimentary to absolute temperature (VCTAT) is produced using at least one of the X transistors. At step 912, a first base-emitter voltage (VBE1) is produced using a first subgroup of Y of the X transistors, where $1 \leqq Y < X$. At step 914, a second base-emitter voltage (VBE2) is produced using a second subgroup of Z of the X transistors, where $Y \leqq z \leqq X$. At step 916, a voltage proportional to absolute temperature (VPTAT) is produced by determining a difference between the first base-emitter voltage (VBE1) and the second base-emitter voltage (VBE2). At step 918, the bandgap voltage is produced by adding the VCTAT to the VPTAT to produce the bandgap voltage. As indicated at step 920, which Y of the X transistors is/are in the first subgroup that are used to produce the first base-emitter voltage (VBE1), and which Z of the X transistors are in the second subgroup that are used to produce the second base-emitter voltage (VBE2), are changed over time (e.g., in a cyclical or random manner). In specific embodiments, which at least one of the X transistors is/are used to produce the VCTAT, change over time (e.g., in a cyclical or random manner). In specific embodiments, Y=1. In other embodiments $Y \leqq 2 < X/2$.

Described above and shown in the figures are just a few examples of VPTAT and bandgap voltage reference circuits where there is selectively controlling of which transistors are used to produce a VPTAT and/or a VCTAT. However, one of ordinary skill in the art will appreciate that the features of embodiments of the present invention can be used with alternative VPTAT circuits and alternative bandgap voltage reference circuits, and that such uses are also within the scope of the present invention. For one example, the selective controlling of which transistors are used to produce a VPTAT and/or a VCTAT can be used with the circuits shown and described in commonly invented and commonly assigned U.S. patent application Ser. No. 11/968,551, filed Jan. 2, 2008, and entitled "Bandgap Voltage Reference Circuits and Methods for Producing Bandgap Voltages", which is incorporated herein by reference.

The bandgap voltage reference circuits of embodiments the present invention can be used in any circuit where there is a desire to produce a voltage reference that remains substantially constant over a range of temperatures. For example, in accordance with specific embodiments of the present invention, bandgap voltage reference circuits described herein can be used to produce a voltage regulator circuit. This can be accomplished, e.g., by buffering VGO and providing the buffered VGO to an amplifier that increases the VGO (e.g., ≈1.2V) to a desired level. Exemplary voltage regulator circuits are described below with reference to FIGS. 10 and 11.

Figure 10:
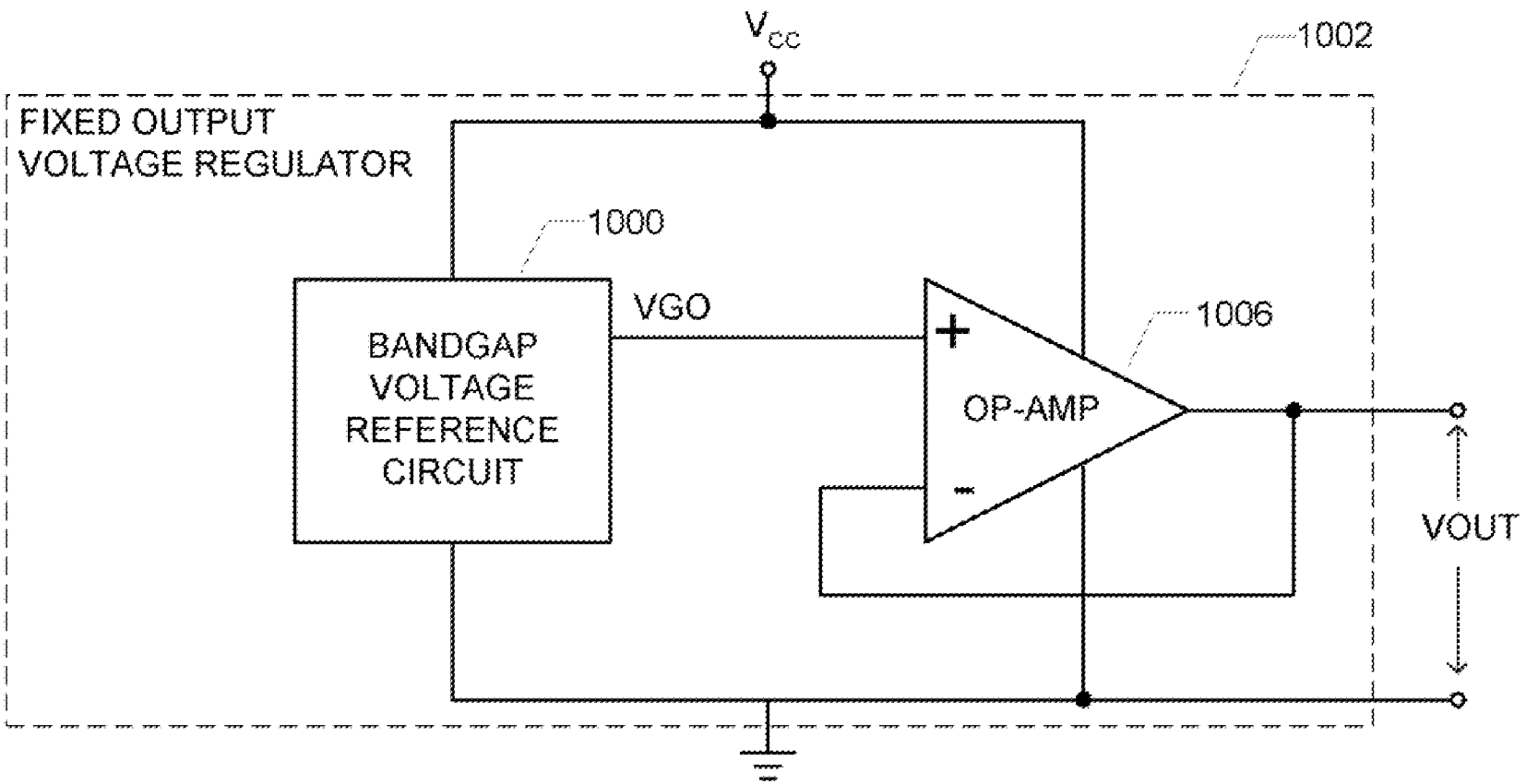
FIG. 10 is a high level block diagram of an exemplary fixed output linear voltage regulator that includes a bandgap voltage reference circuit of an embodiment of the present invention.

FIG. 10 is a block diagram of an exemplary fixed output linear voltage regulator 1002 that includes a bandgap voltage reference circuit 1000 (e.g., one of 400A, 400B, 500A or 500B) of an embodiment of the present invention. The bandgap voltage reference circuit 1000 produces a bandgap voltage output (VGO), which is provided to an input (e.g., a non-inverting input) of an operational-amplifier 1006, which is connected as a buffer. The other input (e.g., the inverting input) of the operation-amplifier 1006 receives an amplifier output voltage (VOUT) as a feedback signal. The output voltage (VOUT), through use of the feedback, remains substantially fixed, +/−a tolerance (e.g., +/−1%).

Figure 11:
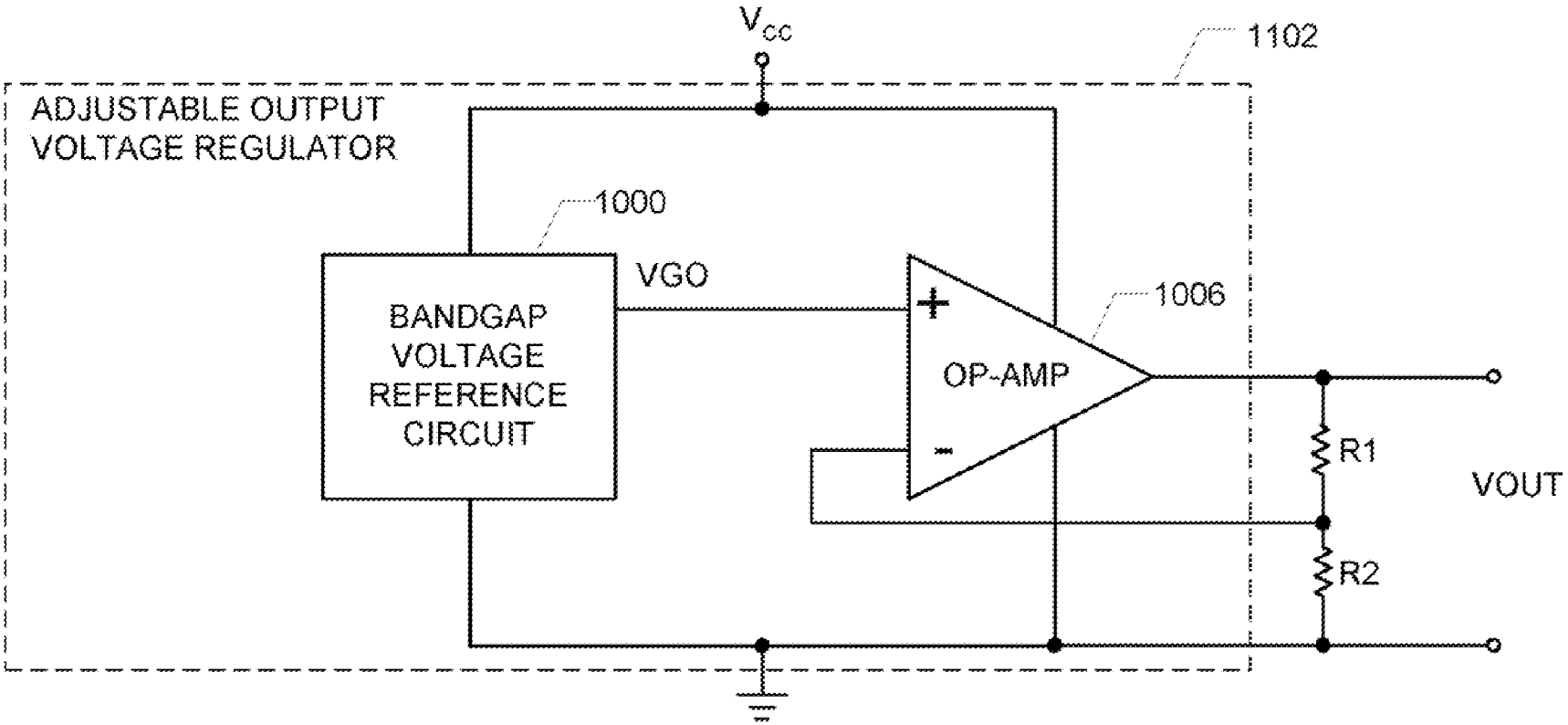
FIG. 11 is a high level block diagram of an exemplary adjustable output linear voltage regulator that includes a bandgap voltage reference circuit of an embodiment of the present invention.

FIG. 11 is a block diagram of an exemplary adjustable output linear voltage regulator 1102 that includes a bandgap voltage reference circuit 1000 (e.g., one of 400A, 400B, 500A or 500B) of an embodiment of the present invention. As can be appreciated from FIG. 11, $VOUT \approx VGO*(1+R1/R2)$. Thus, by selecting the appropriate values for resistors R1 and R2, the desired VOUT can be selected. The resistors R1 and R2 can be within the regulator, or external to the regulator. One or both resistors can be programmable or otherwise adjustable.

Figure 12:
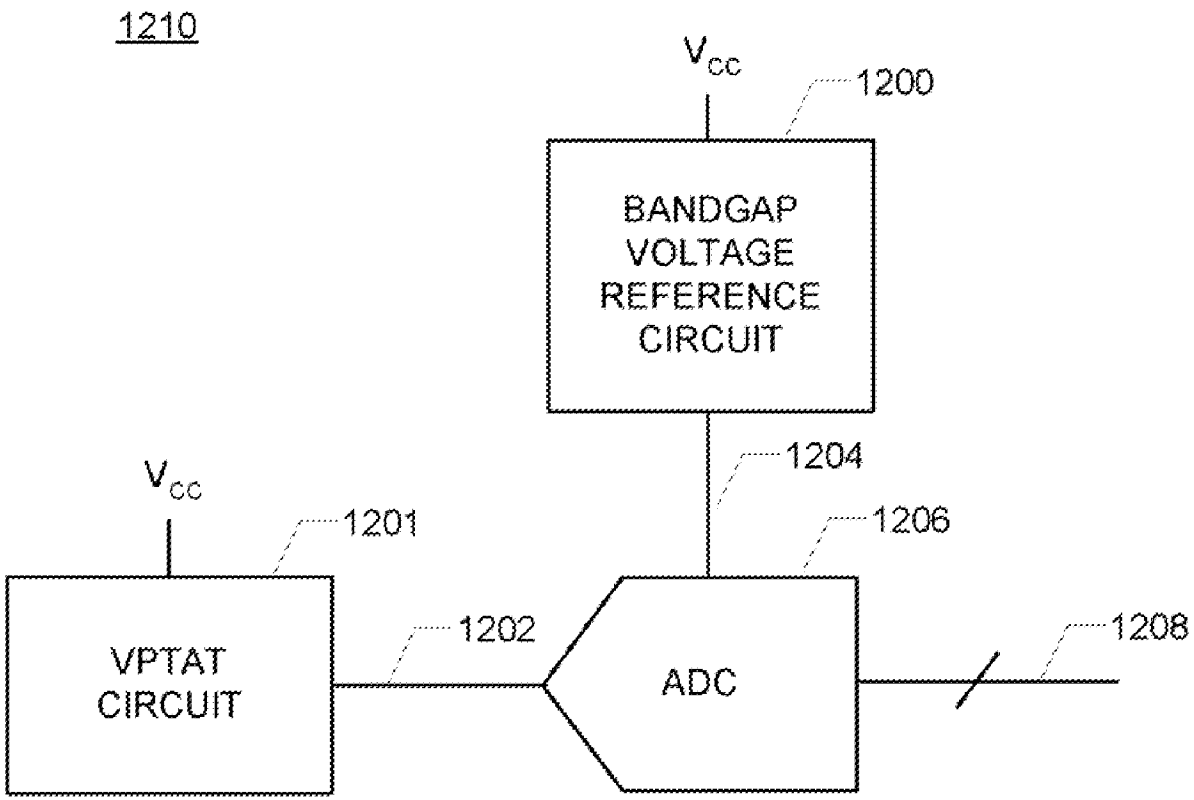
FIG. 12 is a high level block diagram of an exemplary temperature sensor according to an embodiment of the present invention.

The bandgap voltage reference circuits and/or the VPTAT circuits (e.g., 600) of embodiments of the present invention can also be used to provide a temperature sensor. FIG. 12 is an example of such a temperature sensor 1210. A bandgap voltage reference circuit 1200 (e.g., one of 400A, 400B, 500A or 500B) of an embodiment of the present invention can provide a substantially constant bandgap voltage output (VGO) signal 1204 to a reference voltage input of an analog-to-digital converter (ADC) 1206, and a VPTAT circuit 1201 (e.g., 600) of an embodiment of the present invention can provide an analog VPTAT signal 1202 to the signal input of the ADC 1206. In such an embodiment, the output of the ADC 1206 is a digital signal 1208 indicative of temperature, since the input to the ADC 1206 is proportional to temperature. Alternative, a same circuit of an embodiment of the present invention described above can be used to produce both the VGO and the VPTAT, and the VGO can be used to provide a substantially constant reference voltage to the ADC 1206, and the VPTAT (tapped off the circuit) can be provided to the signal input of the ADC 1206. Again, the output of the ADC 1206 is a digital signal 1208 indicative of temperature, since the input to the ADC 1206 is proportional to temperature.

The foregoing description is of the preferred embodiments of the present invention. These embodiments have been provided for the purposes of illustration and description, but are not intended to be exhaustive or to limit the invention to the precise forms disclosed. Many modifications and variations will be apparent to a practitioner skilled in the art. Embodiments were chosen and described in order to best describe the principles of the invention and its practical application, thereby enabling others skilled in the art to understand the invention. Slight modifications and variations are believed to be within the spirit and scope of the present invention. It is intended that the scope of the invention be defined by the following claims and their equivalents.

What is claimed:

1. A circuit to generate a voltage proportional to absolute temperature (VPTAT), comprising:

a group of X transistors, each of which includes a base and a current path between a collector and an emitter;

wherein a first subgroup of Y of the X transistors are used to produce a first base-emitter voltage (VBE1) indicative of a voltage drop between the base(s) of the Y of the X transistors and the emitter(s) of the Y of the X transistors, where $1 \leqq Y < X$;

wherein a second subgroup of Z of the X transistors are used to produce a second base-emitter voltage (VBE2) indicative of a voltage drop between the bases of the Z of the X transistors and the emitters of the Z of the X transistors, where $Y < Z < X$;

wherein the VPTAT is produced by determining a difference between the first base-emitter voltage (VBE1) and the second base-emitter voltage (VBE2); and wherein which Y of the X transistors are in the first subgroup and used to produce the first base-emitter voltage (VBE1), and which Z of the X transistors are in the second subgroup and used to produce the second base-emitter voltage (VBE2), selectively changes over time.

2. The circuit of claim 1, wherein during X periods of time, each of the X transistors is selected in a cyclical manner:

to be in the first subgroup of Y of the X transistors that is/are used to produce the first base-emitter voltage (VBE1); and to be in the second subgroup of Z of the X transistors that are used to produce the second base-emitter voltage (VBE2).

3. The circuit of claim 1, further comprising:

a controller; and a plurality of switches;

wherein the controller controls the switches to select which Y of the X transistors is/are in the first subgroup and used to produce the first base-emitter voltage (VBE1), and which Z of the X transistors are in the second subgroup and used to produce the second base-emitter voltage (VBE2).

4. The circuit of claim 3, wherein:

the controller controls the switches to produce a predictably shaped switching noise that can be filtered; and one or more of the X transistors may be specified to not be used to produce VBE1 or VBE2.

5. The circuit of claim 3, wherein:

the controller selects in a random or pseudo-random manner at least one of which Y of the X transistors is/are selected to be in the first subgroup and used to produce the first base-emitter voltage (VBE1), and which Z of the X transistors are selected to be in the second subgroup and used to produce the second base-emitter voltage (VBE2); and one or more of the X transistors may be specified to not be used to produce VBE1 or VBE2.

6. The circuit of claim 1, wherein Y=1.

7. The circuit of claim 1, wherein $2 \leqq Y < X/2$.

8. The circuit of claim 1, wherein multiple of the switches are controlled at the same time such that multiple switches can be switched at the same time.

9. A method for generating a voltage proportional to absolute temperature (VPTAT) using a group of X transistors, comprising:

producing a first base-emitter voltage (VBE1) using a first subgroup of Y of the X transistors, wherein the first base-emitter voltage (VBE1) is indicative of a voltage drop between the base(s) of the Y of the X transistors and the emitter(s) of the Y of the X transistors, where $1 \leqq Y < X$;

producing a second base-emitter voltage (VBE2) using a second subgroup of Z of the X transistors, wherein the second base-emitter voltage (VBE2) is indicative of a voltage drop between the bases of the Z of the X transistors and the emitters of the Z of the X transistors, where $Y < Z < X$;

producing the VPTAT by determining a difference between the first base-emitter voltage (VBE1) and the second base-emitter voltage (VBE2); and changing over time which Y of the X transistors are in the first subgroup that are used to produce the first base-emitter voltage (VBE1), and which Z of the X transistors are in the second subgroup that are used to produce the second base-emitter voltage (VBE2).

10. The method of claim 9, wherein during X periods of time the changing step includes selecting each of the X transistors in a cyclical manner:

to be in the first subgroup of Y of the X transistors that is/are used to produce the first base-emitter voltage (VBE1); and to be in the second subgroup of Z of the X transistors that are used to produce the second base-emitter voltage (VBE2).

11. The method of claim 9, wherein the changing step comprises selectively controlling which Y of the X transistors are in the first subgroup that are used to produce the first base-emitter voltage (VBE1), and which Z of the X transistors are in the second subgroup that are used to produce the second base-emitter voltage (VBE2), to thereby produce a predictably shaped switching noise that can be filtered.

12. The method of claim 11, wherein the selectively controlling includes not using some of the X transistors to produce VBE1 or VBE2.

13. The method of claim 9, wherein Y=1.

14. The method of claim 9, wherein $2 \leqq Y < X/2$.

15. A bandgap voltage reference circuit, comprising:

a group of X transistors, each of which includes a base and a current path between a collector and an emitter;

a first circuit portion that generates a voltage complimentary to absolute temperature (VCTAT) using at least one of the X transistors; and a second circuit portion that generates a voltage proportional to absolute temperature (VPTAT) that is added to the VCTAT to produce a bandgap voltage output (VGO), the second circuit portion comprising:

a first subgroup of Y of the X transistors that are used to produce a first base-emitter voltage (VBE1), where $1 \leqq Y < X$;

a second subgroup of Z of the X transistors that are used to produce a second base-emitter voltage (VBE2), where $Y < Z < X$; and wherein the VPTAT is produced by determining a difference between the first base-emitter voltage (VBE1) and the second base-emitter voltage (VBE2); and wherein which at least one of the X transistors is/are used to generate the VCTAT, which Y of the X transistors is/are in the first subgroup and used to produce the first base-emitter voltage (VBE1), and which Z of the X transistors are in the second subgroup and used to produce the second base-emitter voltage (VBE2), changes over time.

16. The circuit of claim 15, wherein during X periods of time each of the X transistors is selected in a cyclical manner:

to be at least one of the X transistors that is/are used to generate the VCTAT;

to be in the first subgroup of Y of the X transistors that is/are used to produce the first base-emitter voltage (VBE1); and to be in the second subgroup of Z of the X transistors that are used to produce the second base-emitter voltage (VBE2).

17. The circuit of claim 15, further comprising:

a controller; and a plurality of switches;

wherein the controller controls the switches to select which at least one of the X transistors is/are used to generate the VCTAT;

which Y of the X transistors is/are in the first subgroup and used to produce the first base-emitter voltage (VBE1), and which Z of the X transistors are in the second subgroup and used to produce the second base-emitter voltage (VBE2).

18. The circuit of claim 17, wherein:

the controller controls the switches to produce a predictably shaped switching noise that can be filtered; and one or more of the X transistors may be specified to not be used to produce VBE1 or VBE2.

19. The circuit of claim 15, wherein:

the first base-emitter voltage (VBE1) is indicative of a voltage drop between the base(s) of the Y of the X transistors and the emitter(s) of the Y of the X transistors; and the second base-emitter voltage (VBE2) is indicative of a voltage drop between the bases of the Z of the X transistors and the emitters of the Z of the X transistors.

20. A method for producing a bandgap voltage using a group of X transistors, comprising:

producing a voltage complimentary to absolute temperature (VCTAT) using at least one of the X transistors;

producing a first base-emitter voltage (VBE1) using a first subgroup of Y of the X transistors, wherein the first base-emitter voltage (VBE1) is indicative of a voltage drop between the base(s) of the Y of the X transistors and the emitter(s) of the Y of the X transistors, where $1 \leqq Y < X$;

producing a second base-emitter voltage (VBE2) using a second subgroup of Z of the X transistors, wherein the second base-emitter voltage (VBE2) is indicative of a voltage drop between the bases of the Z of the X transistors and the emitters of the Z of the X transistors, where $Y < Z < X$;

producing a voltage proportional to absolute temperature (VPTAT) by determining a difference between the first base-emitter voltage (VBE1) and the second base-emitter voltage (VBE2); and producing the bandgap voltage by adding the VCTAT to the VPTAT to produce the bandgap voltage; and changing over time which Y of the X transistors is/are in the first subgroup that are used to produce the first base-emitter voltage (VBE1), and which Z of the X transistors are in the second subgroup that are used to produce the second base-emitter voltage (VBE2).

21. The method of claim 20, wherein the changing step comprises selectively controller which Y of the X transistors are in the first subgroup that are used to produce the first base-emitter voltage (VBE1), and which Z of the X transistors are in the second subgroup that are used to produce the second base-emitter voltage (VBE2), to thereby produce a predictably shaped switching noise that can be filtered.

22. The method of claim 21, wherein the selectively controlling includes not using some of the X transistors to produce VBE1 or VBE2.

23. The method of claim 20, wherein one or more of the following are selected in a random or pseudo-random manner:

which Y of the X transistors is/are selected to be in the first subgroup and used to produce the first base-emitter voltage (VBE1);

which Z of the X transistors are selected to be in the second subgroup and used to produce the second base-emitter voltage (VBE2); and which at least one of the X transistors is/are used to produce the VCTAT.

24. The method of claim 20, wherein $Y=1$.

25. The method of claim 20, wherein $2 \leqq Y < Z/2$.

26. The method of claim 20, further comprising changing over time which at least one of the X transistors is/are used to produce the VCTAT.

27. A method for producing a bandgap voltage using a group of X transistors, comprising:

producing a voltage complimentary to absolute temperature (VCTAT) using at least one of the X transistors;

producing a first base-emitter voltage (VBE1) using a first subgroup of Y of the X transistors, where $1 \leqq Y < X$;

producing a second base-emitter voltage (VBE2) using a second subgroup of Z of the X transistors, where $Y < Z < X$;

producing a voltage proportional to absolute temperature VPTAT by determining a difference between the first base-emitter voltage (VBE1) and the second base-emitter voltage (VBE2);

producing the bandgap voltage by adding the VCTAT to the VPTAT to produce the bandgap voltage;

changing over time which Y of the X transistors is/are in the first subgroup that are used to produce the first base-emitter voltage (VBE1), and which Z of the X transistors are in the second subgroup that are used to produce the second base-emitter voltage (VBE2); and changing over time which at least one of the X transistors is/are used to produce the VCTAT.

* * * * *